United States Patent [19]

Arsem

[11] Patent Number: 4,590,684

[45] Date of Patent: May 27, 1986

[54] CONTINUOUS FREEZE DRYING

[75] Inventor: Harold B. Arsem, Richmond, Calif.

[73] Assignee: Eden Research Laboratories, Inc., Richmond, Calif.

[21] Appl. No.: 673,394

[22] Filed: Nov. 20, 1984

[51] Int. Cl.[4] ..... F26B 5/06; F26B 13/30; F25C 1/00

[52] U.S. Cl. ..... 34/5; 34/92; 62/74; 62/347

[58] Field of Search ..... 34/5, 92; 62/74, 347

[56] References Cited

U.S. PATENT DOCUMENTS 3,431,655 3/1969 Grover et al. ..... 34/5

3,445,247 5/1969 Baerwald ..... 34/5

3,477,137 11/1969 Van Gelder ..... 34/5

*Primary Examiner*—John J. Camby

*Attorney, Agent, or Firm*—Trexler, Bushnell & Wolters, Ltd.

[57] ABSTRACT

Apparatus and method for continuous freeze drying in which a slurry of material to be freeze dried is provided. The slurry is advanced along a predetermined path having a freezing area in which one or more plugs of frozen slurry are provided to afford a pressure drop. Heat is applied to the frozen slurry as it exits into an area of reduced pressure. The heat and reduced pressure cause the frozen slurry to sublime.

16 Claims, 4 Drawing Figures

CONTINUOUS FREEZE DRYING

BACKGROUND OF THE INVENTION

When a product is freeze dried it is first frozen and then placed in a low pressure environment where the ice is extracted as a vapor. The direct conversion of ice to water vapor is referred to as sublimation. Freeze drying is often used to preserve materials since the low temperatures minimize the damage during dehydration. In some instances cell cultures can be dried, held in an inactive state for months and then revitalized with the addition of water. This degree of reversibility is not possible with evaporative drying.

Even with the potential of creating food products with a long shelf life at room temperatures, freeze drying has disadvantages. The low pressure requirement adds considerable cost to the process, limiting applications to high value products such as blood, pharmaceuticals, and special foods. With these products the cost of dehydration is small in relation to their overall cost.

Many efforts have been made to reduce the cost of freeze drying. These efforts have been directed towards modifying existing equipment to accelerate the drying rates or by developing continuous processes. The success of this work has depended primarily on the nature of the product being dried. For liquids, such as coffee, continuous processes have been designed that have led to considerable reduction in the dehydration costs. On the other hand, it has been difficult to lower the cost of freeze drying bulky materials, such as fruits and vegetables. These products must be handled in a batch mode which is inherently time consuming.

Development of continuous freeze driers has been impeded by the low pressure conditions necessary for the sublimination of ice. Liquids may be introduced into a low pressure environment by feeding through a small oriface. This makes is possible to regulate the flow of the product from atmospheric pressure into the dryer at a reduced pressure. Bulky foods are more difficult to handle and only a few attempts have made to address this problem. Lock hopper arrangements have been constructed so that products could be introduced and removed from the drying chamber in small batches. The air locks appear to work reasonably well, but they are complex and their use is not widespread.

OBJECTS AND SUMMARY OF THE PRESENT INVENTION

It is an object of the present invention to provide a process and apparatus for continuous freeze drying of slurries through a method of feeding having a controlled pressure drop. More particularly, it is an object of the present invention to provide a process and apparatus for continuous freeze drying wherein the material being freeze dried is forced through pores in a chilled plate where it is frozen, and sublimed upon exit therefrom, the frozen plugs of material in the plate serving to control a pressure drop between the source of material and the low pressure area.

More specifically, it is an object to provide a method and apparatus as set forth in the preceding objects wherein heating means is provided at the exit from the plate to aid in controlling progress of the material through the pores and to facilitate sublimation.

Most specifically, it is an object of the present invention to provide a method and apparatus for freeze drying as set forth in the last preceding object wherein the pores and plate have a diameter so small so as to approach the dimensions of the ice crystals thereby producing an aerosol of sublimed crystals, i.e., a fine dust of submicron size, which may thereafter be sorted or classified by known techniques.

In order to obtain the foregoing and other objects of the present invention I provide a method and apparatus in which a slurry is passed through a chilling region for chilling of the slurry. The slurry comprises an aqueous medium having therein material which is edible, medical, cultures, waste products, etc. The chilled slurry then is forced through a plate having a plurality of pores or bores therethrough. The plate is refrigerated to a low enough temperature to freeze the slurry as it passes through the pores of the plate. A heated exit screen or the like is provided to aid the frozen slurry in moving from the plate, and also to aid in subliming the material as it passes into a low pressure refgrigerated area immediately past the heated screen or the like. Material at this juncture is now freeze dried, and may be collected and handled by normal techniques.

As an embellishment on the method and apparatus the pores through the plate are greatly reduced in size, approaching the dimensions of the ice crystals. Instead of the material vaporizing in a uniform fashion, partially sublimed crystals are sprayed as an aerosol, i.e., a fine dust of submicron size. It is possible to take advantage of this phenomonon since the mean mass diameter of a cell culture is much smaller than most slurries. Through this technique the cellular slurry can be transformed into a fine dust of solids. The components of the aerosol may then be separated through any of a number of established techniques.

THE DRAWINGS

The present invention will best be understood with reference to the following description when taken in connection with the accompanying drawings wherein.

DETAILED DISCLOSURE OF THE ILLUSTRATED EMBODIMENT

Figure 1:
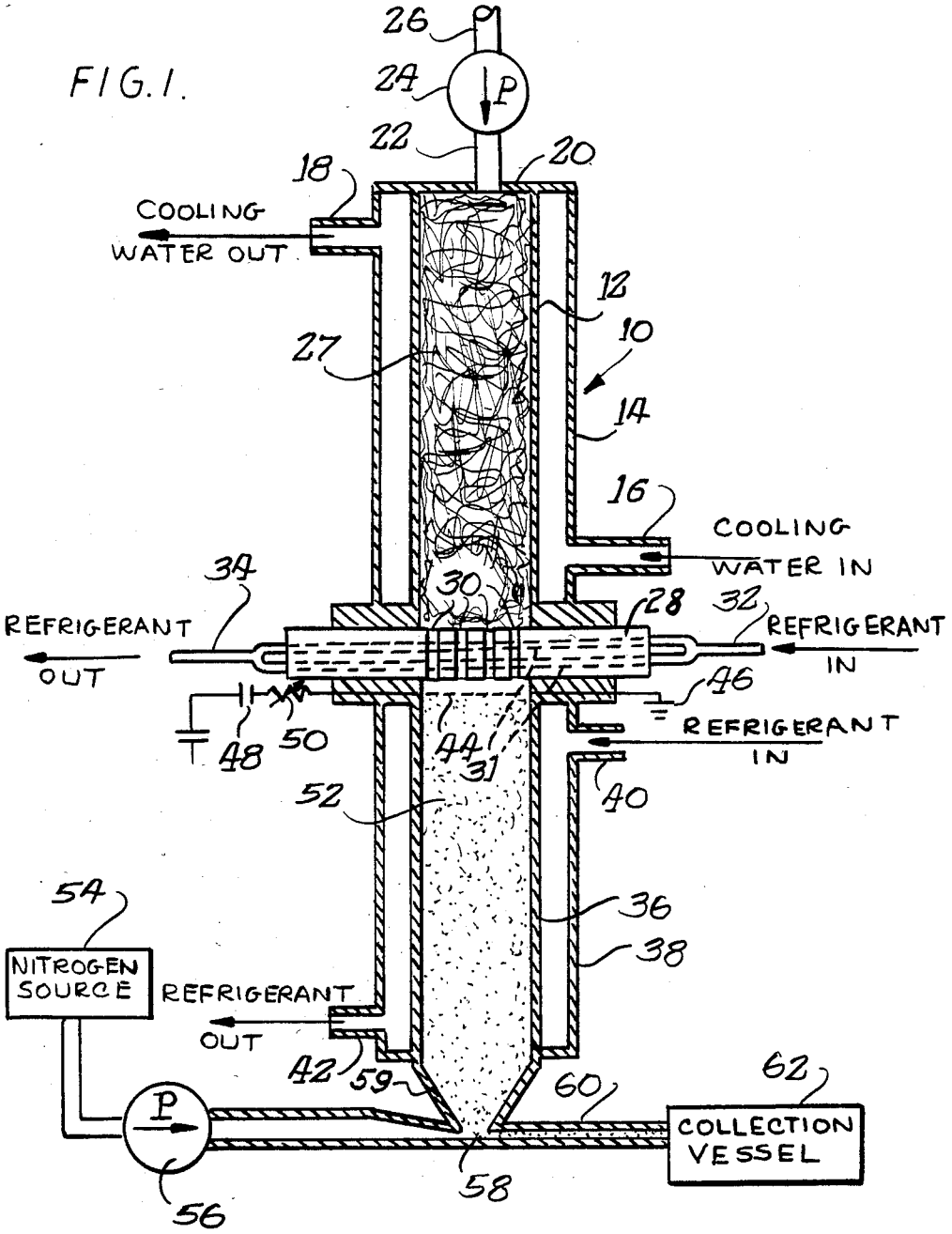
FIG. 1 is a cross-sectional view of an apparatus and method embodying the principles of the present invention.

Turning now in greater particularity to the drawings, and first to FIG. 1, there is shown a freeze drying apparatus 10 constructed in accordance with present invention, and also embodying the method thereof. The freeze drying apparatus includes an upper body portion which conveniently is in the form of a cylindrical tank 12 having a water jacket 14 therearound. Cooling water enters the water jacket through an inlet 16, and exits through an outlet 18. This cooling water preferably is just slightly above freezing temperature. The upper end of the tank 12 is provided with a bulkhead 20 which may be secured in place by any suitable releasable means for access to the interior of the tank for periodic cleaning thereof. An inlet pipe or conduit 22 is supplied from a pump 24 having an inlet 26 to supply slurry 27 under pressure to the interior of the tank 12 where the slurry is chilled. This slurry is of an aqueous nature, and includes in it material which may be edible, or medical, chemical reaction material, cultures, or waste materials. At the bottom of the tank 12 there is provided a transverse cooling plate 28 having a plurality of vertical holes or pores 30 extending therethrough. A refrigerant circulates through suitable channels 31 in the plate, there being a pipe or other connection 32 for refrigerant in, and one for refrigerant out at 34. Conventional refrigerants are used, such as freon or ammonia. The plate is chilled sufficiently to freeze the slurry, and typically would be at minus 20 degrees F. or below, down to perhaps minus 40 degrees F., although the actual range may vary quite considerably with different materials. The slurry moving through the pores 30 is frozen in the plate, and provides a resistance to movement of the chilled slurry 28, which is under pressure from the pump 24.

The pores 30 in the plate 28 open into an evacuated chamber 36 which conveniently is cylindrical and of the same diameter as the input tank 12. A refrigerating jacket 38 encircles the outlet tank 36, and is provided with an inlet 40 for refrigerant, and an outlet 42 for the refrigerant. The refrigerant again is preferably freon or ammonia, and maintains a temperature similar to that of the plate 28. Immediately adjacent to and below the exit from the plate 28 there is provided a heated screen 44 which is heated by resistance electrical means, the screen being shown as grounded at one side at 46, and as having a battery 48 connected to the other side, the opposite terminal of the battery also being grounded to complete the circuit. Suitable conventional means such as a rheostat 50 is provided to control the current through the screen 44, and hence to control the temperature thereof. More modern electronic controls preferably would be used, and the rheostat is shown only as exemplary or symbolic.

The slurry flows downward under gravity and also under pressure of the pump 24 through the tank 12 or cooling prechamber, and then is forced through the chilled porous plate where it is frozen in the holes, channels, or pores. The balance between the pressure on one side and heat on the other side of the plate regulates the flow of material into the evacuated tank, chamber or cavity 36. The pressure drop is held by frozen plugs of material that move slowly through the pores of the chilled plate. The exact temperature and size of the channels or pores will be determined in accordance with the nature of the slurry being handled. It will be appreciated that the pores or channels in the plate must be large enough to accommodate the solids without plugging, but be tight enough to hold the required pressure drop. By way of example, the pores might be as large as one-quarter inch in diameter, although this would probably be a maximum. More typically, the pores would be on the order of one-sixteenth inch in diameter down to micron size.

The frozen particulate material 52 in the tank or evacuated chamber 36 is now ready for long term storage, and for example nitrogen from a source 54 may be pumped through a pump 56 through a venturi arrangement or jet pump 58 at the bottom of the exit tank 36, the bottom portion thereof tapering conically inwardly at 59. The particulate material thus is carried by the nitrogen, which preferably is chilled, from the venturi 58 through a pipe or conduit 60 to a collection vessel 62. The material may be removed on a continuous basis, or on a batch basis from the collection vessel for storage and ultimate use.

Figure 1A:
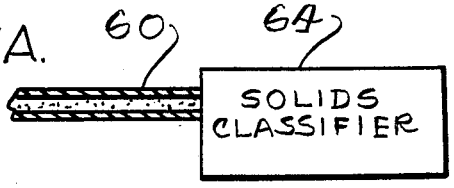
FIG. 1A is a modification of a portion of FIG. 1.

In accordance with one embodiment of the invention the pore diameter of the channels or pores 30 approaches the dimensions of the ice crystals. Instead of the material vaporizing in a uniform fashion, partially sublimed crystals are spread out as an aerosol, i.e., a fine dust of submicron size. It is possible to take advantage of this phenomonon since the mean mass diameter of a cell culture is small. Through this technique the cellular slurry can be transformed into a fine dust of solids. The components of the aerosol are evacuated from the chamber 36 through the venturi arrangement or jet pump 58 into a solids classifier 64 (see FIG. 1A) which takes the place of the collection vessel of FIG. 1, and wherein the solids are subsequently classified or separated through any of a number of established techniques.

The use of a jet pump 58 with a booster pump downstream of the collection systems 62 or 64 normally is sufficient to establish a significant reduction in pressure within the tank or vessel 36, and under most circumstances this will produce a sufficiently low pressure.

In accordance with the second embodiment of the invention wherein the pores or channels are of sufficiently small size as to approach the dimensions of the ice crystals it will be appreciated that freezing or crystal formation takes place essentially in a capillary tube.

The overall size of the freeze drying apparatus 10 may vary quite considerably in accordance with the material being handled, and in accordance with volumetric requirements. The freezing plate 28 has an outside diameter preferably of one foot or less. And the thickness of the plate may be on the order of 4 or 5 inches. However, the plate may be considerably thinner, or somewhat thicker, depending on the material being handled in the slurry, and the temperature at which the plate is maintained.

Figure 2:
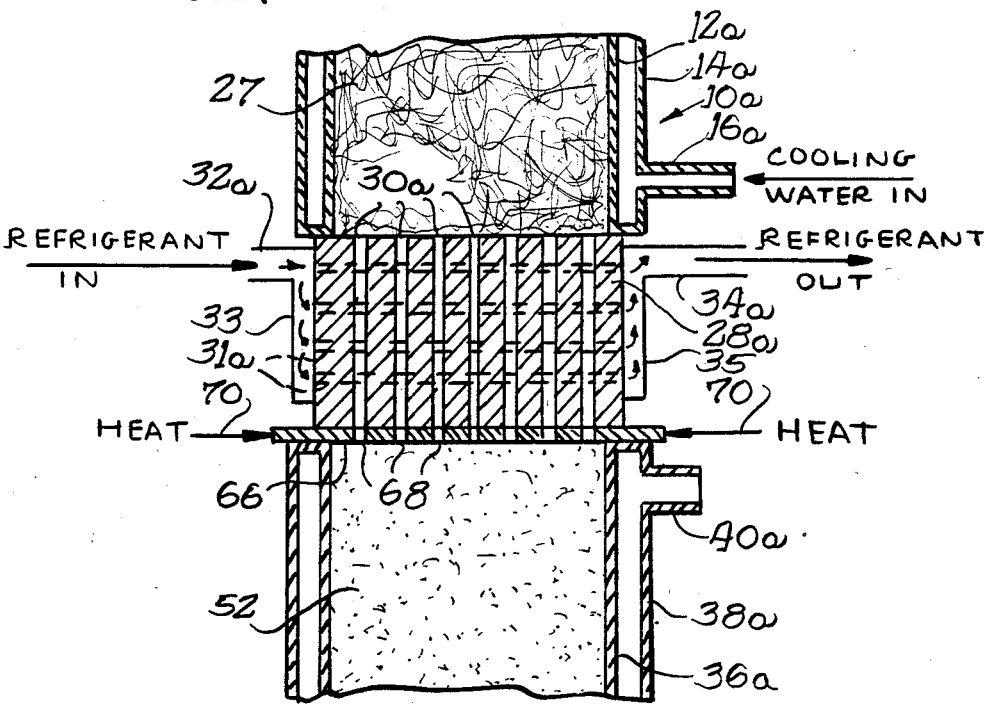
FIG. 2 is a fragmentary cross-sectional view showing a modification of the structure of FIG. 1.

A modification of the invention is shown in FIG. 2 wherein similar parts are identified by similar numerals with the addition of the suffix a to avoid the necessity of repetitive disclosure. The chilling plate **28*a* in this instance is thicker than in the embodiment of FIG. 1, and has a greater number of transverse coolant passageways or channels 31*a*. Inlet and outlet manifolds 33 and 35 are provided for the cross-flow channels 31*a* joined to the respective inlet and outlet conduits 32*a* and 34*a***.

The major change in FIG. 2 as contrasted with FIG. 1 is that instead of a heated screen 44 there is an additional and thinner plate 66 in contact with the freezing plate **28*a* and having openings 68 therethrough forming continuations of the channels or pores 30*a*. This plate is suitably heated, and this can be by the external application of heat as indicated by the arrows 70. Such heat can be by direct contact with a flame or other heating source, by microwave energy, by infrared radiation, or any other suitable means. Preferably the plate 66 is of high heat conductivity, such as of aluminum, to insure uniform temperatures throughout the plate. Action is the same as in connection with the embodiment of FIG. 1**.

Figure 3:
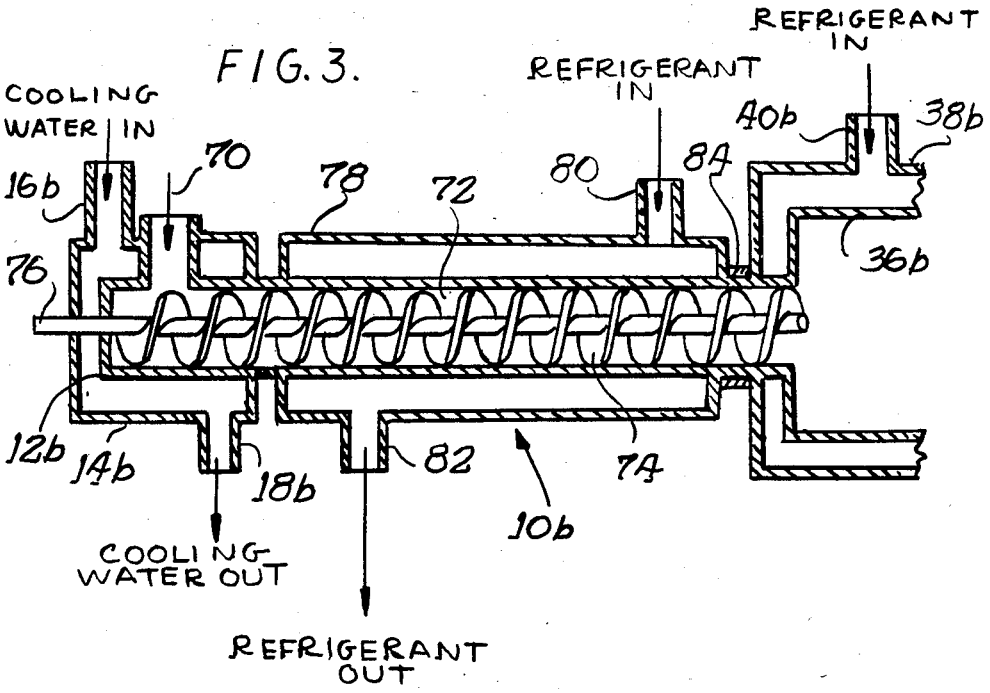
FIG. 3 is a cross-section of a further embodiment of the present invention.

A further embodiment of the invention is shown in FIG. 3. Similar numerals are again utilized to identify like parts with the addition of the suffix b to avoid prolixity of description. Slurry at atmospheric pressure is fed into an inlet 70 of an elongated cylinder 72 having an auger 74 rotatable therein about its cylindrical longitudinal axis. A drive shaft 76 extends axially from the auger, and is driven by any suitable means, such as an electric motor and suitable gearing. The slurry is at atmospheric pressure and may be pre-chilled, but it also may be chilled by a cooling jacket 14*b* against the entrance end of the auger 74, having cooling water circulated therethrough. The water jacket is succeeded by a refrigerant jacket 78 having an inlet connection 80 for refrigerant, and an outlet connection or conduit 82. The slurry is fed from left to right in the drawing upon rotation of the auger, and is progessively and rapidly frozen as it passes through the refrigerant jacket 78.

Adjacent the exit end of the cylinder 72 there is a heating jacket or collar 84 for heating the frozen slurry. The auger opens into an evacuated tank or cylinder 36*b* as in previous embodiments of the invention. The heating collar or jacket 84 may be heated by any suitable means, such as electrical resistance heating, radiant heat, direct conduction, or incorporation of a steam jacket around the collar 84. Operation generally is similar to that previously described in that a plug of frozen slurry surrounds the auger and fills the container or cylinder 72 to insure a pressure drop between the inlet slurry and the evacuated or low pressure tank 36*b*.

A improved process and apparatus for continuous freeze drying has now been described as to a plurality of embodiments. In each case the material being quick frozen is frozen while in motion, and one or more plugs of the frozen material serve to maintain a pressure drop between the inlet and the sublimation region. Heating is applied at the sublimation region to aid in controlling passage of the frozen plug, and to aid in sublimation.

In one embodiment of the invention the channels or pores in which the slurry is frozen are of essentially capillary size so that the frozen slurry crystals exit therefrom as a fine dust or aerosol for subsequent classification.

The specific embodiments of the invention as herein shown and described will be understood as being exemplary. Various changes in structure will no doubt occur to those skilled in the art, and will be understood as forming a part of the present invention insofar as they fall within the spirit and scope of the appended claims.

The invention is claimed as follows:

1. Apparatus for continuous freeze drying comprising an inlet passageway for a slurry and having inlet means and an exit, a plate disposed across said exit and having passageway means therethrough, means for cooling said plate to freeze slurry passing therethrough from said inlet passageway, a sublimation passageway across said plate on the opposite side from said inlet passageway exit, means for chilling said sublimation passageway, means for maintaining a reduced pressure in said sublimation, means for maintaining a pressure drop across said plate including frozen slurry in said passageway means, and heating means adjacent said plate on the opposite side thereof from said inlet passageway exit to aid in controlling movement of said frozen slurry through said passageway means and to augment sublimation thereof upon entry into said sublimation passageway.

2. Apparatus as set forth in claim 1 and further including means for maintaining slurry in said inlet passageway under pressure.

3. Apparatus as set forth in claim 2 wherein the means for maintaining pressure includes a pump connected to said inlet means.

4. Apparatus as set forth in claim 1 and further including means for chilling said inlet passageway.

5. Apparatus as set forth in claim 1 wherein said heating means comprises a screen in said sublimation passageway.

6. Apparatus as set forth in claim 1 wherein said heating means comprises a heating plate in contact with said first mentioned plate and having passageway means therethrough aligned with the passageway means in said first-mentioned plate.

7. Apparatus as set forth in claim 1 wherein the passageway means in said plate have a diameter approaching the size of ice crystals of said slurry.

8. Apparatus as set forth in claim 1 and further including aspirating means interconnected with said sublimation passageway for reducing pressure therein and for conveying freeze dried slurry material therefrom.

9. Apparatus for continuous freeze drying comprising means providing a flow passageway having an inlet portion for a slurry of material to be freeze dried including freezing means for establishing a freezing temperature across a first portion of said flow passageway to freeze slurry passing through said first portion, means for heating a second portion of said flow passageway downstream of said freezing means, and means establishing a reduced pressure in a third portion of said flow passageway downstream of said second portion, frozen slurry maintaining a pressure drop in said passageway between said inlet portion and said third portion, said heating means cooperating with said freezing means and said frozen slurry to control movement of frozen slurry through said first portion, said heating means cooperating with the reduced pressure of said third portion to effect sublimation of the frozen material of said slurry.

10. Apparatus as set forth in claim 9 wherein said inlet portion comprises an inlet passageway, said freezing means comprises an apertured plate across said flow passageway, and said third means comprises a sublimation passageway interconnected with said inlet tank, said heating means being adjacent said apertured plate on the sublimation passageway side thereof.

11. Apparatus as set forth in claim 9 wherein said inlet portion and said first and second portions comprise a cylinder, and further including an auger extending through said cylinder for feeding slurry therethrough.

12. A continuous freeze drying process including the steps of providing a slurry of material to be freeze dried, continuously flowing said slurry along a continuous path, freezing said slurry at a predetermined area of said path to maintain a pressure drop across said area, heating said slurry immediately downstream of said predetermined area, and exposing said frozen and heated slurry to a reduced pressure to effect sublimination of the frozen material.

13. The process as set forth in claim 12 including the further step of chilling said slurry upstream of the predetermined freezing area.

14. The process as set forth in claim 12 including the further step of passing the slurry through restricted passageways in said predetermined freezing area and freezing said slurry in said passageways.

15. The process as set forth in claim 14 wherein said restricted passageways have a diameter sufficiently small as to form an aerosol of material exiting from said passageways.

16. The process as set forth in claim 12 including the step of using an auger to feed said slurry along said continuous path.

* * * * *